United States Patent [19]

Hayashi et al.

[11] Patent Number: 4,571,064

[45] Date of Patent: Feb. 18, 1986

[54] OPTICAL ELEMENT POSITIONING APPARATUS FOR USE IN ELECTROPHOTOGRAPHIC COPYING MACHINE

[75] Inventors: Masamichi Hayashi, Aichi; Yukio Tokura, Toyohashi, both of Japan

[73] Assignee: Minolta Camera Kabushiki Kaisha, Osaka, Japan

[21] Appl. No.: 596,824

[22] Filed: Apr. 3, 1984

[30] Foreign Application Priority Data

May 19, 1983 [JP] Japan ..... 58/75082[U]

[51] Int. Cl.[4] ..... G03G 15/00

[52] U.S. Cl. ..... 355/8; 355/57; 355/58

[58] Field of Search ..... 355/8, 11, 55, 56, 57, 355/58

[56] References Cited

U.S. PATENT DOCUMENTS 3,884,574 5/1975 Doi et al. .
3,897,148 7/1975 Ritchie et al. .
3,947,188 3/1976 Simpson .
4,118,118 10/1978 Barto, Jr. ..... 355/8
4,139,298 2/1979 Tani .

FOREIGN PATENT DOCUMENTS 55-52439 12/1980 Japan .
0075674 6/1981 Japan ..... 355/8

*Primary Examiner*—R. L. Moses
*Assistant Examiner*—J. Pendegrass
*Attorney, Agent, or Firm*—Wenderoth, Lind & Ponack

[57] ABSTRACT

The invention is concerned with an apparatus for positioning optical elements of a lens for projecting an image of an original and a mirror for directing the image of the original from the lens toward a photosensitive medium. And the lens and mirror cooperate with movable optical members for scanning the original. The position of the optical elements are changed continuously or steplessly to a position corresponding to the newly selected magnification. For changing the magnification continuously, the lens in supported continuously shiftably along an optical path, and the mirror is supported continuously shiftably along the optical path from the lens and pivotally movable relative to the optical path. The lens and mirror are driven by a force of a single drive source via drive force transmitting mechanism.

4 Claims, 5 Drawing Figures

OPTICAL ELEMENT POSITIONING APPARATUS FOR USE IN ELECTROPHOTOGRAPHIC COPYING MACHINE

FIELD OF THE INVENTION

The present invention relates to an optical element positioning apparatus for use in electrophotographic copying machines, and more particularly to an apparatus useful for variable magnification electrophotographic coying machines for positioning optical elements which are held at rest in a position corresponding to the desired magnification during copying operation and which are shifted with a change of magnification.

BACKGROUND OF THE INVENTION

Magnification varying mechanisms of various constructions have been proposed for use in copying machines of different types. With copying machines of the platen scanning optics type wherein an original on the platen is scanned by movable optical elements in the form of a slit and the image of the original is transmitted to a moving photosensitive surface by stationary optical elements including a projection lens, the magnification is varied generally by changing the scanning speed of the movable optical elements in corresponding relation to the desired magnification and shifting the projection lens in a direction along the optical path. When the projection lens is a fixed focal lens, the total conjugate distance varies with the magnification, so that the length of the optical path must be corrected between the original and the photosensitive surface so as to become equal to the total conjugate distance.

For correcting the length of optical path with a variation of magnification, U.S. Pat. No. 3,884,574 discloses an arrangement wherein a first scanner movable at a first speed and a second scanner movable at one half the first speed serve as the movable optical elements, the second scanner being shiftable relative to the first scanner. However, the second scanner, which performs a scanning movement, requires complicated means for shifting.

U.S. Pat. No. 3,947,188 discloses another arrangement for correcting the length of optical path in which the mirror disposed between the original and the projection lens or between the projection lens and the photosensitive drum is a roof mirror comprising two mirror segments and movable along the center or bisecting line of the roof mirror. This mode of shifting the roof mirror has the advantage that the beam incident on the mirror and the beam reflected therefrom remain unchanged in position despite the movement of the mirror. Nevertheless, if such arrangement is used for a transfer copying machine of the platen scanning optics type, there is a need to use at least two mirrors for scanning because an even number of mirrors must be arranged between the original and the photosensitive drum. In the case where these two mirrors individually serve as a first scanner and a second scanner, the optical path becomes non-parallel to the original, entailing the drawback of making the optical system bulky.

Published Examined Japanese Utility Model Application SHO No. 55-52439 discloses still another arrangement in which the second scanner comprises two mirrors disposed at a right angle so that the optical path folded by the first and second scanners will be parallel to the original. For a magnification change, the projection lens is shifted, while a mirror for reflecting the beam through the projection lens toward the photosensitive drum is slidingly moved along the optical axis of the projection lens to correct the length of optical path. The mirror is pivotally movable between a first position and a second position to make beams incident on the photosensitive drum at a definite angle despite changes of magnification. However, with this arrangement in which the angle of incidence of beams on the drum is made definite independently of the magnification, the position where the beam is incident on the drum differs with the magnification circumferentially of the drum. Because the image formed on the drum is transferred to copy paper, the movable optical system and the paper feeder are controlled in synchronism to bring the leading end of the image in register with the leading end of the copy paper, whereas a complex mode of control is required if the position of the incident beam on the drum differs from magnification to magnification.

Moreover, the arrangements disclosed in the above-mentioned prior art references are merely adapted for two- to three-step magnification changes and are therefore unable to meet the recent demand for multistep magnification changes or substantially continuous or stepless magnification changes.

SUMMARY OF THE INVENTION

Accordingly the main object of the present invention is to provide an optical element positioning apparatus by which a lens and a mirror can be positioned properly for multistep or substantially continuous magnification changes without causing changes in the position of incident beam on a photosensitive drum due to the magnification changes.

Another object of the present invention is to provide an optical element positioning apparatus which is suitable for use in compact and inexpensive copying machines.

These main and other objects of the present invention can be fulfilled by an optical element positioning apparatus useful for a variable magnification copying machine which has movable optical elements for scanning an original, a lens for projecting an image of the original and a mirror for directing the image of the original from the lens toward a photosensitive medium, the apparatus comprising means for supporting the lens continuously shiftably along the optical path, means for supporting the mirror continuously shiftably in a direction along the optical path from the lens to make the length of the optical path equal to the total conjugate distance corresponding to the position of the lens and pivotally movable relative to the optical path to make images of originals incident on the photosensitive medium always at a definite position, a drive source, first means for transmitting a drive force of the drive source to the lens to locate the lens in a position corresponding to a selected magnification, and second means for transmitting the drive force of the drive source to the mirror supporting means to give the mirror a position and an angle corresponding to the selected magnification.

More specifically the mirror is pivotably supported by a holding member which is shiftable along the optical path from the lens, and the mirror supporting means includes an eccentric cam rotatable in contact with the holding member to shift the holding member and a slanting cam fixedly disposed in bearing contact with a portion of the pivotably supported mirror, the holding member being shiftable by the rotation of the eccentric cam to pivotally move the mirror in response with the shifting movement.

More specifically the holding member is so adapted that the mirror supporting position is adjustable relative to the eccentric cam and that the angle of the mirror is adjustable relative to the slanting cam.

These and other objects, advantages and features of the invention will become apparent from the following description thereof taken in conjunction with the accompanying drawings which illustrate a specific embodiment of the invention.

BRIEF DESCRIPTION OF THE DRAWINGS

In the following description, like parts are designated by like reference numbers throughout the several drawings.

DETAILED DESCRIPTION OF THE INVENTION

An embodiment of the present invention will be described below with reference to the accompanying drawings.

Figure 1:
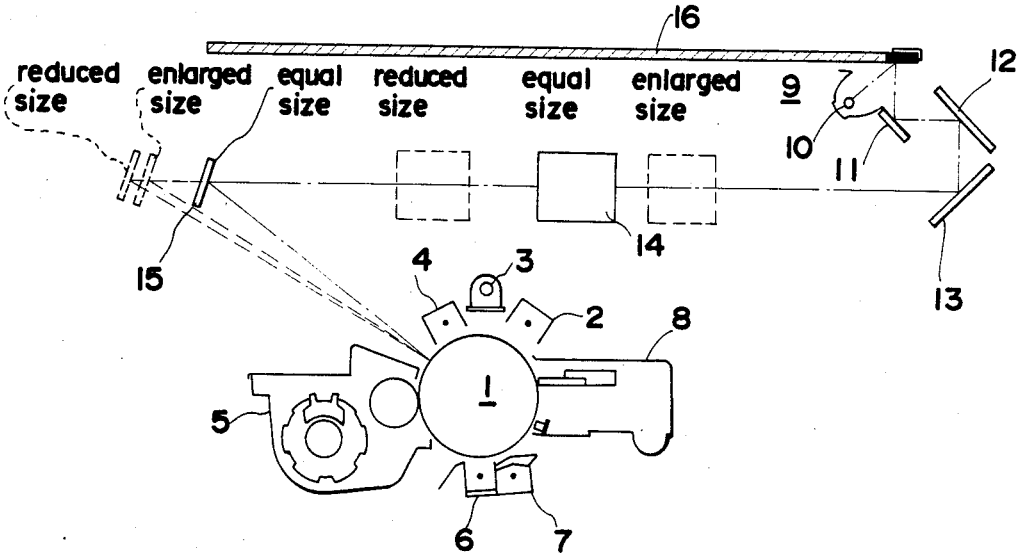
FIG. 1 is a sectional view schematically showing an electrophotographic copying machine of the platen scaning optics type.

FIG. 1 is a sectional view schematically showing an electrophotographic copying machine incorporating an optical element positioning apparatus according to the invention. A photosensitive drum 1 drivingly rotatable in a counterclockwise direction is disposed approximately in the center of the main body of the copying machine. Arranged around the drum 1 are a subcharger 2, eraser lamp 3, main charger 4, dry-type developing unit 5, transfer charger 6, charger 7 for separating copy paper and blade-type cleaner 8. The drum 1 has a $CdS.nCdCO_3$ resin binder photosensitive member on its surface. The photosensitive member is sensitized and charged by the chargers 2, 4 and eraser lamp 3 and exposed to an optical image from an optical system 9.

The optical system 9 comprises movable optical elements for scanning an original from below a document support glass plate 16, and stationary optical elements for transmitting onto the drum 1 an image of the original scanned by the movable optical elements. More specifically the movable optical elements include a first scanner which has an illuminating lamp 10 and a first mirror 11 and travels at a speed of V/m wherein V is the peripheral speed of the drum and m is magnification, and a second scanner which has a second mirror 12 and a third mirror 13 disposed at a right angle therewith and travels at a speed of V/2m following the first scanner. On the other hand, the stationary optical elements include a lens 14 for projecting the image of the original and a fourth mirror 15 for directing the image from the lens toward the drum 1.

For copying operation, the original is scanned by the movable optical elements at a speed ratio of 2:1, and the original image therefrom is transmitted by the stationary optical elements at rest onto the drum 1 rotating at a given speed.

For a magnification change, the stationary optical elements are shifted to a predetermined position in accordance with the desired magnification, and the movable optical elements are set to a scanning speed corresponding to the magnification. With the present embodiment, the magnification is variable substantially continuously (steplessly). Thus, the position of the stationary optical elements and the scanning speed of the movable optical elements are varied substantially continuously. Stated more specifically the magnification is variable from an enlarged scale (X1.4) to the original scale (X1) and then to a reduced scale (X0.64).

The movable optical elements are driven by a D.C. motor through a wire. The D.C. motor is urged by pulse width-modulated pulses from a phase locked control loop. The speed of the D.C. motor thus controlled is variable, for example, by the known technique disclosed in U.S. Pat. No. 4,190,350.

Referring to FIG. 1 again, the copying machine further has unillustrated paper feeder, paper transport means and fixing unit. The electrostatic latent image corresponding to the original and formed on the drum 1 by the optical system 9 is converted by the developing unit 5 to a toner image, which is then transferred by the transfer charger 6 onto paper transported from the paper feeder. The fixing unit fixes the image to the paper, which is thereafter discharged from the machine.

The optical element positioning apparatus of the invention will be described with reference to FIGS. 2 to 5. The apparatus is adapted to continuously shift the lens 14 in accordance with a selected magnification, to correct the resulting variation of the total conjugate distance by continuously shifting the fourth mirror 15 and, at the same time, to pivotally move the fourth mirror so that the images of originals reflected from the mirror 15 are incident on the drum 1 at the same position despite the change of magnification.

The optical element positioning apparatus generally comprises a lens displacement mechanism 30, a mirror displacement mechanism 40 and a mirror pivoting mechanism 60, and a stepping motor 20 and a drive transmission mechanism for driving these mechanisms.

Figure 2:
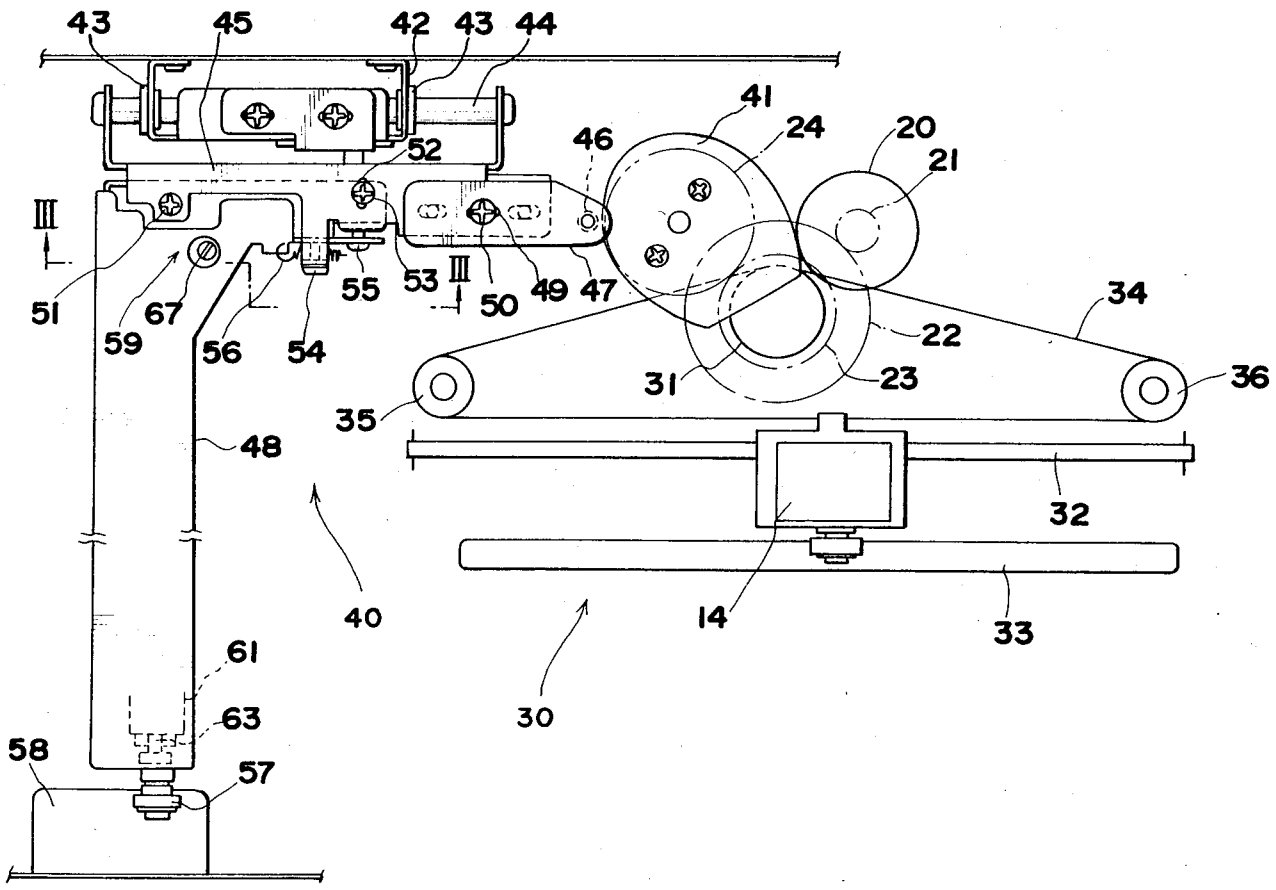
FIG. 2 is a plan view showing a preferred embodiment of optical elements positioning apparatus of the present invention.

With reference to FIG. 2, the stepping motor 20 has fixed to its output shaft a drive gear 21 meshing with a first intermediate gear 22. A drive pulley 31 and a second intermediate gear 23 are fixed to the shaft of the first intermediate gear 22. The second intermediate gear 23 is in mesh with a third intermediate gear 24 fixed to the same shaft as an eccentric cam 41 for continuously moving the mirror 15.

Accordingly the drive force of the stepping motor 20 is transmitted to the drive pulley 31 of the lens displacement mechanism 30 through the drive gear 21 and the first intermediate gear 22. The drive force is also transmitted to the eccentric cam 41 of the mirror displacement mechanism 40 via the first intermediate gear 22, the second intermediate gear 23 and the third intermediate gear 24.

The lens displacement mechanism 30 comprises a guide shaft 32 and a guide rail 33 which are arranged in parallel with the optical axis and have the lens 14 movably mounted thereon, and a wire 34 wound around the drive pulley 31 and reeved around freely rotatable pulleys 35, 36 fixedly provided at opposite ends of the path of movement of the lens. The wire 34 has an intermediate portion attached to a side portion of the lens 14.

The mirror displacement mechanism 40 has the following construction. A slide rod 44 is slidably supported by bearings 43, 43 mounted on a bracket 42 which is fixed to the main body. A slide plate 45 is fixed to the slide rod 44. The slide plate 45 is provided with a mirror holding member 48 and a cam contact plate 47 which has a collar 46 bearing against the eccentric cam 41.

The cam contact plate 47 is formed with a slot 49 and has two pins extending from the rear side thereof away from the plane of FIG. 2. A screw 50 through the slot 49 is screwed in a threaded hole formed in the slide plate 45, which is further provided with slots for the two pins to engage in. When the screw 50 is loosened, the position of the cam contact plate 47 is adjustable relative to the slide plate 45. Since lenses 14 are difficult to make with exactly the same focal distance and therefore involve errors occurring during manufacture, the position of the plate 47 is adjusted chiefly to compensate for such error.

On the other hand, the mirror holding member 48 is supported by a screw 51 so as to be pivotally movable in a horizontal plane relative to the slide plate 45 and is fixed in place by a screw 53 screwed in the member 48 through a slot 52 formed in the slide plate 45. The pivoted position of the mirror holding plate 48 is adjustable by loosening the screws 51, 53 and then advancing or retracting a screw 54 and another screw 55. The screw 54 is screwed in a downwardly bent portion (see FIG. 3) of the slide plate 45 and has a forward end bearing against the mirror holding member 48. The screw 55 is inserted through a lug of the holding member 48 in screw-thread engagement therewith and has a forward end bearing against another downwardly bent portion of the slide plate 45. The mirror holding member 48 can be properly positioned at right angles with the optical axis by the adjustment.

By a spring 56 having one end attached to the mirror holding member 48 and the other end engaged with the main body, the mirror holding member 48 is biased in the direction in which the collar 46 bears against the eccentric cam 41. The holding member 48 is provided at its free end with a roller 57 rollable on a frame plate 58 of the main body.

Figure 3:
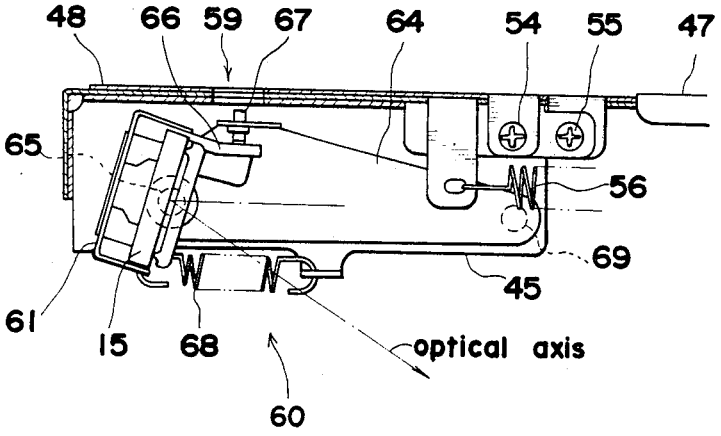
FIG. 3 is a view in section taken along the line III—III in FIG. 2.
Figure 4:
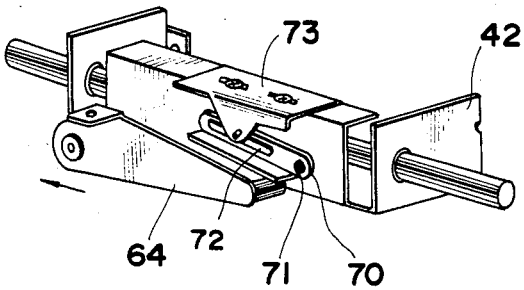
FIG. 4 is a fragmentary perspective view showing a mirror pivoting mechanism.
Figure 5:
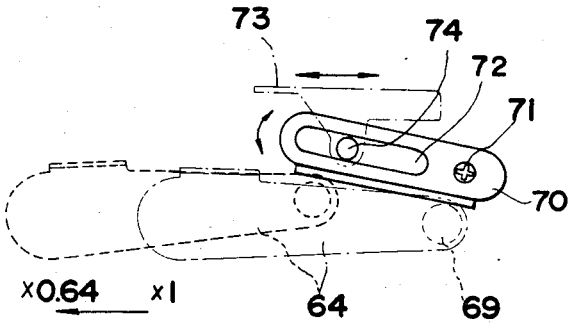
FIG. 5 is a schematic view illustrating adjustment of amount of pivotal movement of the mirror pivoting mechanism.

Next, the mirror pivoting mechanism 60 will be described with reference to FIGS. 3, 4 and 5. In FIG. 3, the mirror 15 is fixedly supported by a mirror holder 61, which is pivotably supported by the mirror holding member 48. The mirror holder 61 has a bearing cavity at each end. A pivotal lever 64 is pivoted to the slide plate 45 and has a pivot 65. The mirror holder 61 is supported as above by the shaft 63 of the roller 57 engaged in one of the cavities and by the pivot 65 engaged in the other cavity as shown partly also in FIG. 2. Toward the slide plate, the mirror holder 61 has a projection 66. A screw 67 screwed in a bent upper portion of the pivotal lever 64 has a forward end bearing on the projection 66. By a spring 68 connected between the holder 61 and the slide plate 45, the holder 61 is biased in the direction in which the projection 66 bears against the screw 67. The screw 67 is adjustable through an opening 59 formed in the upper wall of the mirror holding member 48.

The pivotal lever 64 has at its free end a collar 69. The collar 69 bears against a cam plate 70 adjustably provided on the fixed bracket 42 and having a continuous cam face. The cam face of the cam plate 70 is inclined relative to the optical path from the lens 14. The cam plate 70 is rotatably attached to the fixed bracket 42 by a pivot 71 and has an elongated groove 72. An adjusting plate 73 slidably mounted on the fixed bracket 42 has a pin 74 engaged in the groove 72. Accordingly the cam plate 70 is rotatable about the pivot 71 by loosening screws fastening the adjusting plate 73 to the fixed bracket 42 and sliding the plate 73 (see FIG. 5).

The optical system is so designed that the optical axis will be incident on the photosensitive drum 1 in alignment with a normal of the drum surface when the system is set to the maximum magnification because if the incident optical axis is out of alignment with the normal to a greater extent, the image is deformed more markedly. A reduced resolution will then result since the system is of the scanning type. The system is therefore adapted to align the incident beam with the normal when set to the maximum magnification at which the image is enlarged to the greatest scale. The amount of pivotal movement of the mirror 15 is corrected at the original scale position and the maximum reduction scale position.

The mirror 15 is adjusted at the original scale position by adjusting the contact between the pivotal lever 64 and the mirror holder 61. More specifically, in the original scale position, the screw 67 in contact with the mirror holder 61 is advanced or retracted through the opening 59 in the mirror holding member 48 to adjust the position where the light beam from the mirror 15 is incident on the drum 1.

In the maximum reduction scale position, the mirror 15 is adjusted by adjusting the angle of the cam plate 70, i.e. by sliding the adjusting plate 73 to rotate the cam plate 70 about the pivot 70 so that the beam from the mirror 15 will be incident on the drum 1 at the same position as the position of incidence on the original scale.

Because of the above construction, the lens 14 is moved substantially continuously to the position of desired magnification in the range of from X14 to X0.64, while the mirror 15 is moved to the position of the conjugate distance in accordance with the lens position. The mirror 15 is also moved pivotally so that the images of originals will be incident on the drum 1 at the same position at any magnification. These movements are effected in operative relation by a drive force from the single drive source.

This will be described in greater detail. When an input of desired magnification data is fed to the apparatus from an operation panel or the like, a predetermined number of pulses are applied to the stepping motor 20 based on the data to rotate the stepping motor 20 as specified. The predetermined number of the pulses is such that the stepping motor 20 thereby rotated forwardly or reversely shifts the lens 14 from the original scale position thereof, which is detected photoelectrically, to the position of desired magnification.

The rotation of the stepping motor 20 is transmitted to the lens 14 through the drive gear 21, first intermediate gear 22, drive pulley 31 and wire 34 to shift the lens 14.

The rotation delivered to the first intermediate gear 22 is transmitted also to the eccentric cam 41 by way of the second intermediate gear 23 and third intermediate gear 24, moving the slide plate 45, mirror holding member 48 and parts attached thereto wholly to bring the mirror 15 to the position corresponding to the desired magnification.

The movement of the mirror holding member 48 changes the position where the pivotal lever 64 is in contact with the cam plate 70, pivotally moving the lever 64. This movement is transmitted from the screw 67 to the mirror holder 61 to turn the mirror holder 61. Consequently the position where the beam reflected from the mirror 15 is incident on the drum 1 can be held definite in spite of the change in the magnification.

The optical element positioning apparatus described is incorporated into a copying machine which is adapted to vary the magnification in a very large number of steps or substantially continuously, making it possible to accurately locate the lens and mirror in the position corresponding to the selected magnification. Moreover the mirror is pivotally moved simultaneously with the positioning movement to cause the images of originals to be incident on the photosensitive drum always at the same position notwithstanding the variations of magnification. The optical system is therefore easy to control in synchronism with the copy paper.

Further with the apparatus of the invention, the optical elements to be moved for the variation of magnification are limited only to the stationary optical elements. This permits the movable optical elements to have a simple structure. Further because only a single mirror is included in the stationary optical elements, the movable optical elements can be of such construction that the second scanner is composed of two mirrors and the optical path folded by the first and second scanners is in parallel with the original. This arrangement renders the copying machine compact.

Although the present invention has been fully described by way of example with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An optical element positioning apparatus for use in a variable magnification copying machine which has movable optical members for scanning an original, a lens for projecting an image of the original and a mirror for directing the image of the original from the lens toward a photosensitive medium, the apparatus comprising;

means for supporting the lens continuously shiftably along the optical path from the optical members, means for suporting the mirror continuously shiftably along the optical path from the lens to make the length of the optical path equal to the total conjugate distance corresponding to a selected magnification and pivotally movable relative to the optical path to make the image of the original incident on the photosensitive medium always at a definite position, said mirror supporting means having a shiftable member shiftable along the optical path from the lens, a holding member which holds the mirror and is supported pivotally on said shiftable member, an eccentric cam in contact with said shiftable member to shift the shiftable member, and a fixed position slanting cam in bearing contact with a portion of the holding member to move the mirror pivotally, a drive source, first means for transmitting a drive force of the drive source to the lens to locate the lens in a position corresponding to a selected magnification, and second means for transmitting the drive force of the drive source to said eccentric cam to give to the mirror supporting means a position and an angle corresponding to the selected magnification, whereby the position of the lens and the mirror can be changed substantially continuously to a position of newly selected magnification.

2. An optical elememt positoning apparatus as claimed in claim 1, wherein the shiftable member includes a cam contact member contacting the eccentric cam and the position of the cam contact member is adjustable relative to the shiftable member for compensating for the error of an optical path length.

3. An optical element positioning apparatus as claimed in claim 1, wherein the shiftable member includes a first part supported shiftably about a main body and a second part supporting the holding member and being adjustable in pivotal movement against the first part in a horizontal plane relative to the shifting direction of the first part, so that the mirror can be properly positioned at right angles with the optical axis by the adjustment of the second part.

4. An optical element positioning apparatus as claimed in claim 1, wherein the holding member includes a mirror holding part and a slant cam contact part, both of which are adjustable for adjusting the angular displacement relative to the optical path.

* * * * *